US012622498B2

(12) United States Patent
Charraud et al.

(10) Patent No.: US 12,622,498 B2
(45) Date of Patent: May 12, 2026

(54) CLEANSING DEVICE HAVING A NEBULIZER AND A SUCTION UNIT

(71) Applicant: L'OREAL, Paris (FR)

(72) Inventors: Grégoire Charraud, Clichy (FR); Dominic Akerele, Clark, NJ (US); Nicholas Sinclair, Clark, NJ (US); Matthieu Jacob, Clichy (FR)

(73) Assignee: L'Oreal, Paris (FR)

( * ) Notice: Subject to any disclaimer, the term of this patent is extended or adjusted under 35 U.S.C. 154(b) by 206 days.

(21) Appl. No.: 18/546,048

(22) PCT Filed: Jan. 31, 2022

(86) PCT No.: PCT/EP2022/052171
§ 371 (c)(1),
(2) Date: Aug. 10, 2023

(87) PCT Pub. No.: WO2022/175066
PCT Pub. Date: Aug. 25, 2022

(65) Prior Publication Data

US 2024/0115025 A1 Apr. 11, 2024

(30) Foreign Application Priority Data

Feb. 18, 2021 (FR) ..... 21 01565

(51) Int. Cl.
*A45D 19/16* (2006.01)
*A45D 24/22* (2006.01)
*A45D 24/32* (2006.01)

(52) U.S. Cl.
CPC ..... *A45D 19/16* (2013.01); *A45D 24/22* (2013.01); *A45D 24/32* (2013.01); *A45D 2200/207* (2013.01)

(58) Field of Classification Search
CPC ..... A45D 19/16; A45D 24/22; A45D 24/32
See application file for complete search history.

(56) References Cited

U.S. PATENT DOCUMENTS

2008/0141467 A1* 6/2008 Wood ..... C23C 14/24 8/405
2015/0053227 A1* 2/2015 Sugunan ..... A45D 7/00 132/142

(Continued)

FOREIGN PATENT DOCUMENTS

CN 2 285 580 Y 7/1998
DE 3800954 C1 4/1989

(Continued)

OTHER PUBLICATIONS

International Search Report issued May 20, 2022 in PCT/EP2022/52171, filed on Jan. 31, 2022, 3 pages.

(Continued)

*Primary Examiner* — Nicholas D Lucchesi
(74) *Attorney, Agent, or Firm* — Christensen O'Connor Johnson Kindness PLLC

(57) ABSTRACT

A device for cleansing and applying a composition to the hair, including a body structure having a first, dispensing opening and a second, vacuum opening, a nebulizer with an outlet connected to the first, dispensing opening, a vacuum system with an inlet connected to the second, vacuum opening, and a handle extending the body structure, the body structure having a support having a peripheral edge delimited by a perimeter line, and application elements extending from a longitudinal face of the support.

12 Claims, 3 Drawing Sheets

(56) References Cited

U.S. PATENT DOCUMENTS

| | | | | |
|---|---|---|---|---|
| 2021/0267345 | A1* | 9/2021 | Besen | A45D 24/007 |
| 2022/0087393 | A1* | 3/2022 | Kosecoff | A46B 15/0034 |
| 2022/0087406 | A1* | 3/2022 | Kosecoff | A46B 9/023 |
| 2022/0088407 | A1* | 3/2022 | Kosecoff | A61N 5/0617 |
| 2022/0095782 | A1* | 3/2022 | Kosecoff | A46B 15/003 |
| 2022/0160576 | A1* | 5/2022 | Kosecoff | A45D 24/22 |

FOREIGN PATENT DOCUMENTS

| | | | |
|---|---|---|---|
| EP | 0 659 363 | A1 | 6/1995 |
| FR | 2003401 | A1 | 11/1969 |
| JP | 2007-296206 | A | 11/2007 |
| JP | 2009-28173 | A | 2/2009 |
| KR | 102077103 | B1 | 2/2020 |

OTHER PUBLICATIONS

Chinese First Office Action mailed Jul. 25, 2025, in corresponding Chinese Application No. 202280015404.0, filed Jan. 31, 2022, 13 pages.

* cited by examiner

[Fig. 1]
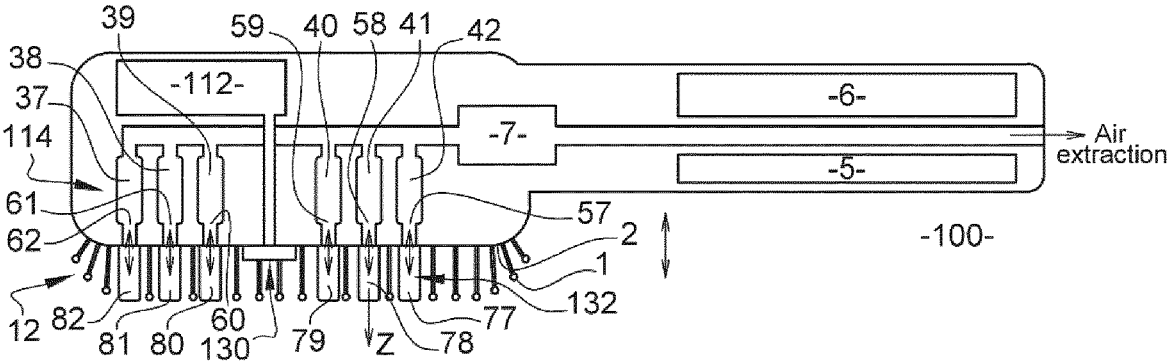
[Fig. 2]
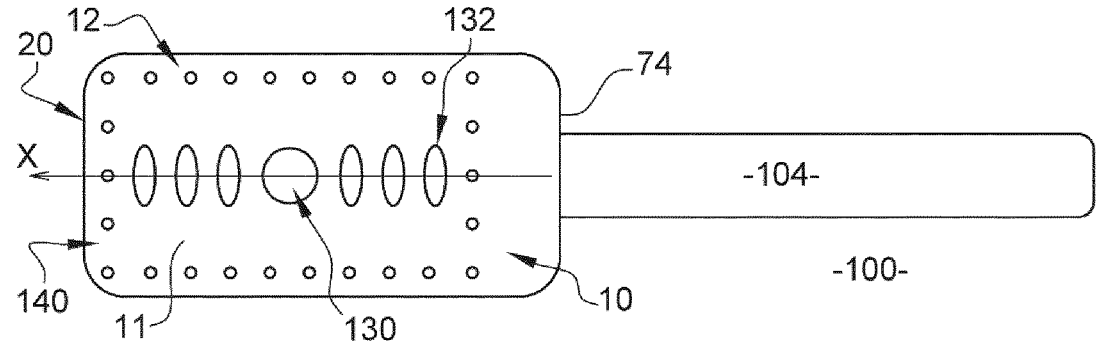
[Fig. 3]
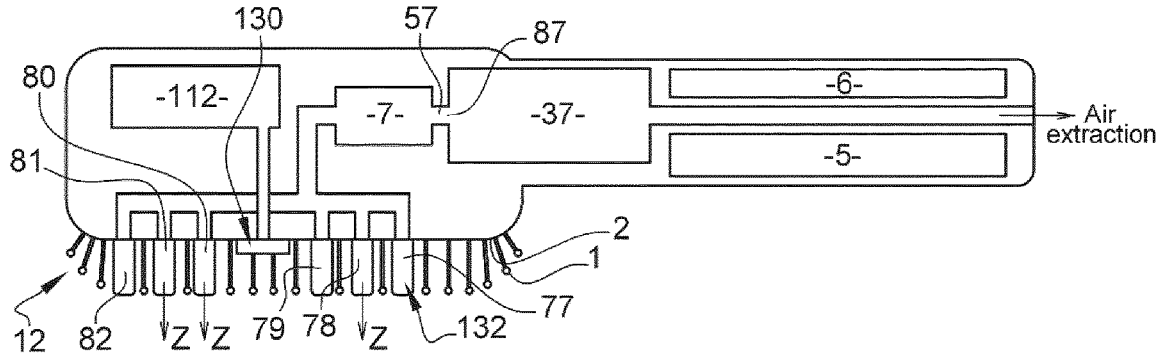
[Fig. 4]
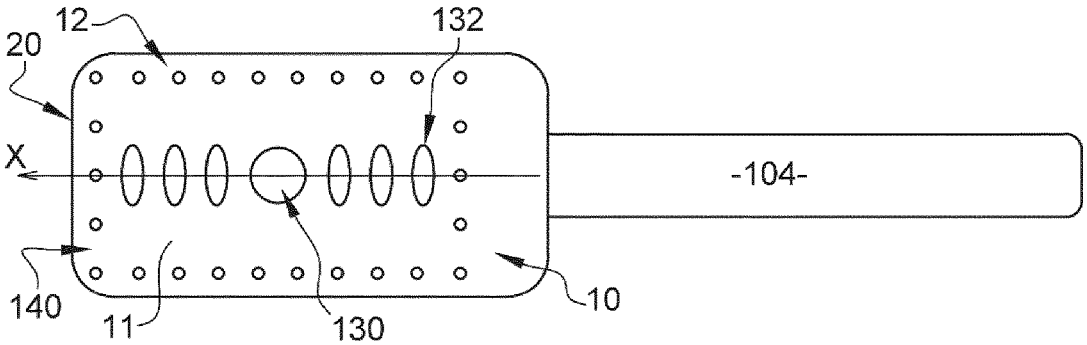

[Fig. 5]
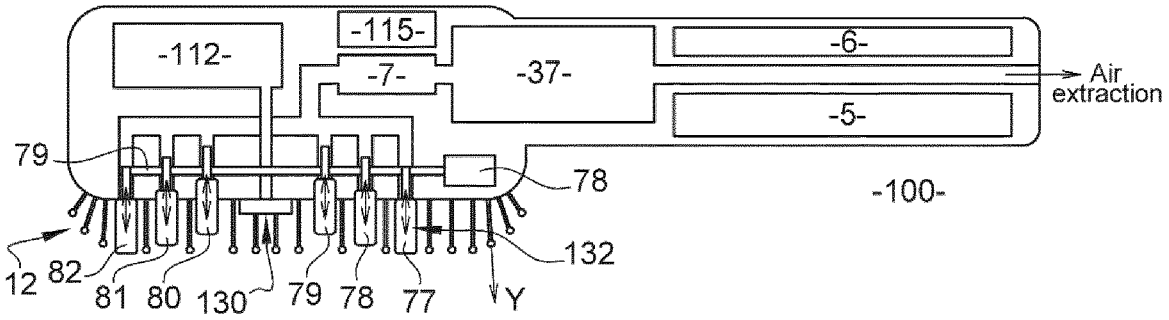
[Fig. 6]
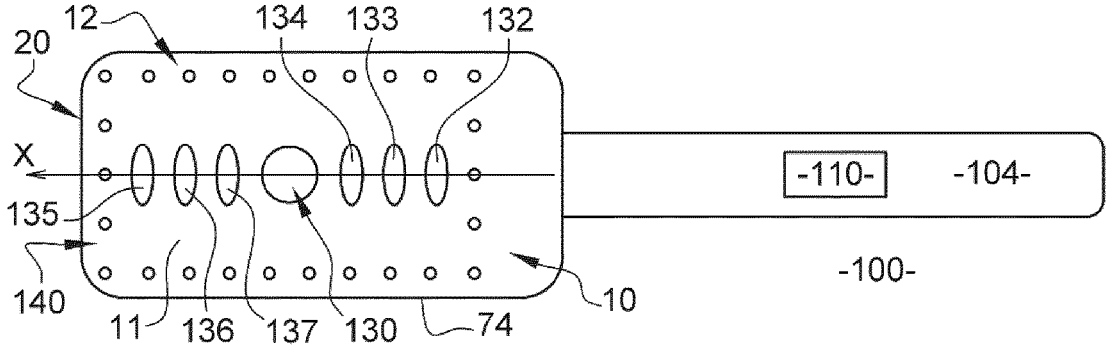
[Fig. 7]
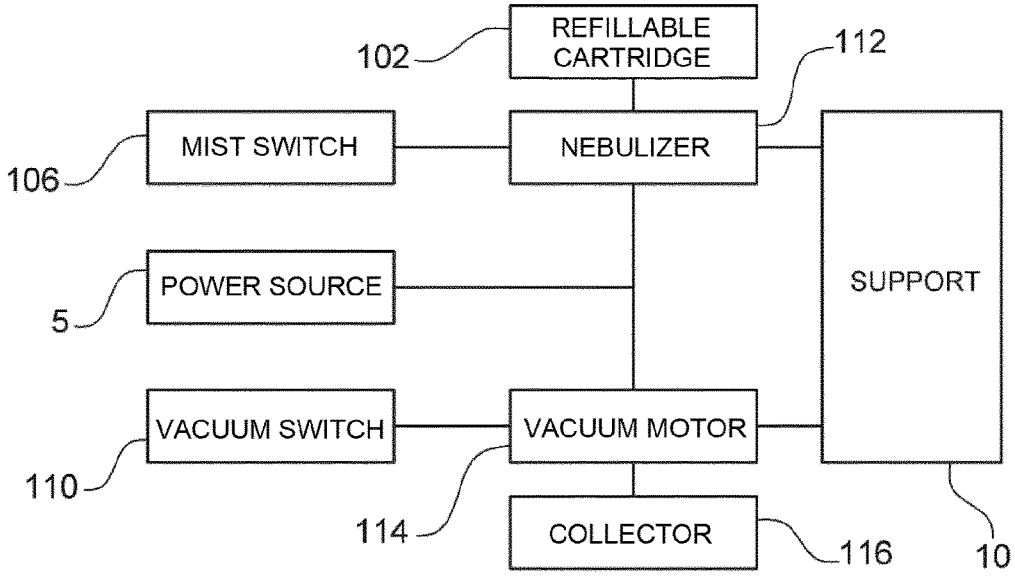

[Fig. 8]
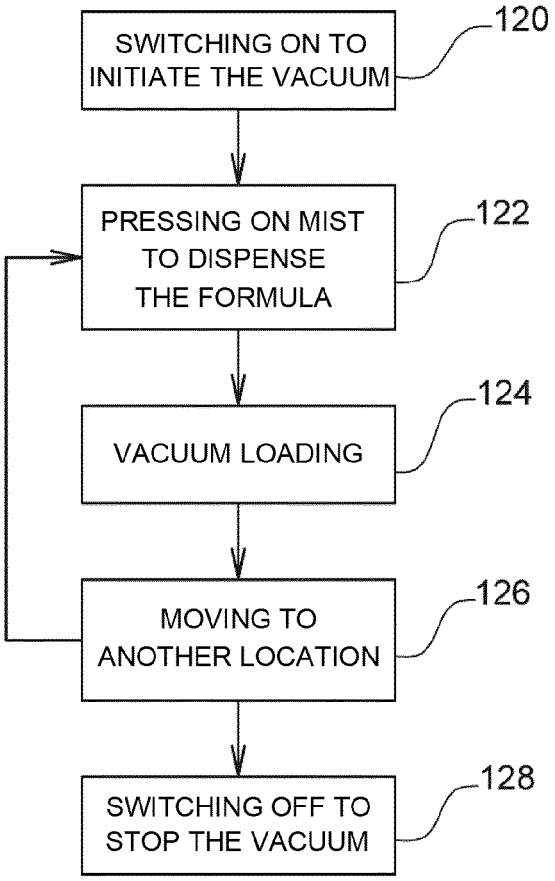

CLEANSING DEVICE HAVING A NEBULIZER AND A SUCTION UNIT

The present invention relates to a cosmetic device for treating hair fibres, in particular for cleansing the hair.

More generally, a cosmetic product is a product as defined in Regulation (EC) No 1223/2009 of the European Parliament and of the Council of 30 Nov. 2009 on cosmetic products.

TECHNOLOGICAL BACKGROUND

Haircare devices that dispense a cleansing fluid are known.

The patent DE3800954 discloses a hair styling device having a hollow rotary body provided on its external circumferential surface with protrusions and recesses for winding, shaping and drying the hair. The body can be driven by a motor disposed in a housing in the form of a handle, with blowing openings arranged in the protrusions and suction openings arranged in the recesses. The openings are connected via ducts to a soundproof central device which contains at least one fan, an outlet connector, an intake connector and an air heater. Via the outlet openings, a permanent-waving, fixing, hair-dyeing agent or other hair treatment agent in the form of steam can be discharged through a blowing nozzle extending parallel to the hollow body along the housing. The hair treatment agent reaches the hair, while excess components are sucked in immediately by the suction openings.

The patent application EP0659363A1 discloses a device for treating the hair, having a generator, a tool holder provided with a gripping handle, and a tool. The generator and the tool holder are designed to provide the tool with at least one supply of steam. They are positioned at a distance from one another and connected by a flexible bundle having at least one duct for supplying the tool holder with steam. The tool holder supports a steam outlet channel, the wall of which has steam dispensing orifices passing through it. The generator may be designed to pass other fluids through the tool, the other fluids being able to be blown and/or sucked through the tool.

The French patent application no. 2003401, filed by the Applicant on 6 Apr. 2020, discloses a device for applying a formulation to the hair, which comprises a body structure having one or more teeth at a front end, wherein one end of a tooth includes a first and a second opening; a nebulizer with an outlet connected to the first opening; a vacuum system with an inlet connected to the second opening; and a handle continuing the body structure at an obtuse angle with respect to the front end of the body structure.

Definition of the Invention

The invention aims to provide a device for cleansing human keratin fibres, in particular the hair, making it possible to cleanse said fibres effectively with a cleansing composition, and to improve and shorten the routine of removing the particles of a mixture of sebum and shampoo from the hair and the scalp after the cleansing composition has been applied.

In particular, the aim of the invention is to provide a, preferably portable and compact, device which is capable of washing the hair effectively without rinsing with water being necessary.

To this end, the invention provides an all-in-one device that is capable of dispensing a composition onto the hair, the scalp or the roots, of mixing the composition with the sebum, and of removing, with the aid of a suction system, the waste generated by this mixture, the suction system comprising a low-noise air pump or water pump that is easy to incorporate in the body of the device.

Definition of the Invention

The subject of the invention is a device for cleansing and applying a composition to the hair, comprising a body structure comprising a first, dispensing opening and a second, vacuum opening, a nebulizer with an outlet connected to the first, dispensing opening, a vacuum system with an inlet connected to the second, vacuum opening, and a handle extending the body structure, the body structure having a support having a peripheral edge delimited by a perimeter line, the support extending along a longitudinal axis X, and application elements extending from a longitudinal face of the support along a longitudinal axis Y, the application elements having a first, free end and a second end connected obliquely or perpendicularly to the longitudinal face of the support, the first, dispensing opening and the second, vacuum opening opening onto the longitudinal face of the support without passing through the application elements.

In one embodiment, the device removes more than "macro" particles such as dandruff. The device provides a cleansing formulation together with massaging for dissolving and absorbing the oils, sebum, and other odour-trapping articles so as to leave the hair with signs of cleanliness/refreshing. The device creates a mist for dispersing the formulation, and includes teeth for mechanical massaging, and removal under vacuum so as to achieve the aim of cleansing.

Since the device can cleanse the hair in an equivalent manner to a shampoo used in the shower, the hair is subsequently easy to style, resulting in hair that is healthier for longer.

By virtue of the specific disposition of the first, dispensing opening and the second, vacuum opening in the support, the cosmetic composition is distributed effectively on the hair and the scalp and cleansing is effective on account of good distribution of suction.

Advantageously, the device according to the invention comprises a formula misting system or nebulizer, a system of hairbrush bristles forming the application elements, and an air pump capable of removing sebum and dirt from the scalp and the roots of the hair.

Mechanism of Action:

The mister/atomizer or nebulizer dispenses a composition targeting the scalp and the roots of the hair.

The application elements such as bristles allow the user to activate the formula with the sebum.

The formula dissolves the oil and sebum and puts them into suspension.

The vacuum system, in particular the air pump system, sucks in the excess formula and sebum through the second, vacuum openings, which target the scalp and the roots of the hair.

Along at least a part of its length, the support may have a substantially constant thickness.

Main Definitions

A "cross section of a component of axis X" is a section perpendicular to the axis X of the component.

The "longitudinal axis of a component" denotes the line connecting all of the centres of mass of the cross sections of a component.

Preferred Embodiments

Preferably, the application element according to the invention has one or more of the following features, taken individually or in combination:

The longitudinal face is flat. The performance aspects of the device are enhanced.

The support has an external surface of non-circular shape in cross section perpendicularly to the longitudinal axis X.

The support has an external cross section perpendicularly to the longitudinal axis X of polygonal and/or flattened shape. The quality of combing and suction is better.

The application elements are closer to the perimeter line than to the longitudinal axis X. The device according to the invention may style a larger area of hair.

The first, dispensing opening and the second, vacuum opening are closer to the longitudinal axis X than to the perimeter line. The openings are centred for better distribution of the composition and better suction.

The application elements are disposed in rows, the bases of the application elements in a row being in particular aligned or disposed in a staggered manner. The combing of the hair is more regular.

The support has a symmetric shape relative to a median plane, in particular a median plane containing the longitudinal axis X of the support. It is easier to use the device.

The vacuum system comprises an air pump or a water pump, in order to reduce noise.

It has a suction nozzle that is movable in translation along its longitudinal axis Z and ends with the second, vacuum opening, a drive mechanism setting the suction nozzle in motion with an oscillating movement along the longitudinal axis Z. With this drive system, the suction nozzles may come into contact with the scalp at regular time intervals, thereby promoting the removal of sebum. Each suction nozzle may be equipped with an oscillating mechanism.

Each suction nozzle is connected to a pump outlet by its own dedicated outlet duct, in order to avoid any loss of suction power. Each suction nozzle may target the scalp and the roots of the hair.

At least two suction nozzles are connected to the same outlet of a pump by a common outlet duct. In this case, the device is, preferably, equipped with a system for blocking the channels of which the nozzle is not in contact with the zone to be treated, in order to limit the loss of vacuum power caused by these open channels. This system may comprise valves and/or solenoid valves and/or pressure sensors.

The first, dispensing opening is positioned at the centre of the longitudinal face of the support. The distribution of the composition onto the hair is optimal.

DESCRIPTION OF THE FIGURES

Further features and advantages of the invention will become apparent from reading the following detailed description of nonlimiting illustrative embodiments thereof and from examining the appended drawing, in which:

FIG. 1 is a schematic illustration of a device employing several pumps and several suction nozzles;

FIG. 2 is a top view of the device in FIG. 1;

FIG. 3 is a schematic illustration of a device employing a single pump and several suction nozzles;

FIG. 4 is a top view of the device in FIG. 3;

FIG. 5 is a schematic illustration of a device according to FIGS. 3 and 4 employing a cam system for producing tapping of the suction nozzles;

FIG. 6 is a top view of the device in FIG. 5;

FIG. 7 is a schematic illustration of components of the device in FIGS. 1 to 6; and FIG. 8 is a flow chart of a method for using a device according to FIGS. 1 to 6.

FIGS. 1 to 6 show different embodiments of a device 100 for applying and removing shampoo. The device 100 is an electrically powered device including a nebulizing component for misting, spraying or atomizing a shampoo formulation through a first, dispensing opening 130 connected to a nebulizer 112 and a vacuum component for removing the shampoo used and any waste or oils removed by washing with the shampoo formulation through a second, vacuum opening 132. In one embodiment, the shampoo formulation is a liquid shampoo formulation.

The device 100 is formed by a body structure 140 comprising the first, central dispensing opening 130 for dispensing the composition in the form of droplets and six nozzles 77, 78, 79, 80, 81, 82 that are provided with vacuum openings 132, 133, 134, 135, 136, 137 and connected to a vacuum system 114 having a filtering unit 7 and a control unit 6. The openings are aligned along the longitudinal axis X.

The vacuum system 114 comprises, in the example shown, six vacuum pumps connected to a pump outlet 37, 38, 39, 40, 41, 42 by their own dedicated outlet ducts 57, 58, 59, 60, 61, 62.

The support 10 may be fixed or movable relative to the handle 104 of the device 100 or the device may have a member for ejecting the support 10 in order to replace the support after use.

The support may have a central housing containing the nebulizer 112 and vacuum system 114.

The vacuum openings may have a circular, oval, oblong shape, and preferably, all the vacuum openings are the same shape. Preferably, the longitudinal axis Z of the nozzles 77, 78, 79, 80, 81, 82 lies in the longitudinal median plane of the support 10. Thus, suction is effected more uniformly.

According to another embodiment of the invention, the nozzles 77, 78, 79, 80, 81, 82 follow one another in a staggered manner on either side of a median plane of the support 10.

The support 10 of longitudinal axis X may have, in particular, a cross section perpendicularly to the axis X, in its portion that is intended to come into contact with the hair, that is not circular, for example polygonal, in particular hexagonal, triangular, square, octagonal, or rectangular.

The support 10 may also be made with a flattened shape, for example at least in its distal part, as illustrated in the figures.

The support 10 may be made with a constant material thickness, in particular in its portion intended to come into contact with the hair. The material thickness may also be non-constant.

The device 100 has a handle 104 and the body structure 140 has a support 10 that is elongate along the longitudinal axis X and has a free peripheral edge 20 delimited by a perimeter line 74. This device is designed to comb the hair. It is more suitable than a cylindrical sleeve designed to form curls, generally without disentangling.

Preferably, the application elements 12 are moulded in one piece with the support 10 and are preferably made of an elastomer material so as to make the device flexible.

The application elements 12 may have a cylindrical or pyramidal shape, in particular with a triangular base, for example with an edge oriented towards the outside of the support.

The base of the application elements 12 may also be oval or polygonal.

In one embodiment, the device 100 is formed in the style of familiar appliances for the hair that are widely recognized to inspire confidence in the device, resulting in a use and hand movements that are intuitive during use.

The device 100 may include a housing which takes a removable cartridge 102 that contains shampoo and is connected to the nebulizer 112. The cartridge may be configured as a refillable cartridge or a disposable cartridge. In one embodiment, the device 100 may be configured to hold more than one cartridge.

The device 100 is provided with application elements 12 that extend from the longitudinal face 11 of the support 10 along a longitudinal axis Y. The application elements 12 have a first, free end 1 and a second end 2 connected to the longitudinal face 11 of the support 10.

The application elements 12 may in particular be bristles, tufts of bristles, spikes, teeth, protrusions. They may have a cross section that is constant perpendicularly to their longitudinal axis Y or for example have a conical shape decreasing in size gradually from the second end 2 to the first end 1 or vice versa. The end 2 may be rounded for a massaging effect and the end 1 may have a chamfer.

The rounded ends of the application elements 12 may separate the hair for easier access to the scalp and the roots of the hair. The rounded ends may include "massaging bosses" and a chamfered angle for cleansing.

Nebulizer 112

The nebulizer 112 produces mist on demand, for example upon pressing a mist switch 106 positioned for example on the handle 104 to allow it to be operated with the index finger. In one embodiment, the mist switch 106 is a momentary action switch, the default position of which is the off position. When the mist switch 106 is pressed, the nebulizer 112 is started and produces mist. The nebulizer 112 is supplied with shampoo formulation by the cartridge 102. Releasing the mist switch 106 may stop the nebulizer and the dispensing of shampoo formulation through the first, dispensing orifice 130.

In one embodiment, the mist switch is a multifunctional, multi-position selector, which requires the positive selection of the off position to stop the nebulizer. In one embodiment, the mist switch is a multiple-position selector which has settings for stopping and more than one setting for producing mist, such as light mist or thick mist. In one embodiment, a mist selector may include settings for dispensing mist and without mist.

In one embodiment, the nebulizer 112 includes a compressor, a pump, or an ultrasonic wave generator for generating the mist from the shampoo formulation. In the case of a nebulizer having a pump or compressor 112, such a nebulizer 112 causes air or the shampoo formulation to flow at high speed, propelling the shampoo formulation through a fine nozzle designed to form mist at the opening 130.

In one embodiment, a manually controlled pump mechanism is used to propel the shampoo formulation through the atomizing nozzle at the opening 130. In the case of a nebulizer having a pump or compressor, a single nebulizer 112 may be positioned in the body structure of the device 100. Next, the output of the nebulizer 112 having a pump or compressor is guided through a system of ducts towards the first opening 130.

An ultrasonic wave nebulizer 112 has an ultrasonic wave generator in contact with the shampoo formulation, wherein the frequency of the ultrasonic waves is sufficient for producing the mist. An ultrasonic wave nebulizer also includes a "mesh" nebulizer which has a vibrating mesh that just touches the surface of the shampoo formulation to create mist. Any form of ultrasonic wave nebulizer may use a piezoelectric element. In the case of an ultrasonic wave nebulizer or mesh nebulizer, the nebulizer 112 including a piezoelectric element or a combination of a piezoelectric element and a mesh, the device 100 essentially has three nebulizers.

The shampoo formulations may include, without being limited thereto, formulations that include one or more absorbents of any kind in a vector. The vectors include alcohols or water. The absorbents may include starch or maize or clays such as kaolinite, montmorillonite, smectite. A surfactant, such as fatty acid anionic surfactants, may be included to prevent agglomeration. If it is provided in the form of a foam or aerosol, the shampoo formulation may include a propellant gas.

The cartridge is connected to the nebulizer 112 to supply the formulation for the hair to the nebulizer 112 through any suitable duct for feeding the nebulizer 112 with shampoo formulation when the nebulizer 112 is controlled. Advantageously, the formulation for the hair does not need to be mixed with external water compared with a shampoo used in the shower.

Vacuum System 114

In one embodiment, the vacuum system has a vacuum generating motor 114 controlled by a vacuum switch 110 and a collector 116. The vacuum motor includes for example wheel vanes which cause a flow of air to enter through the vacuum inlet openings 132. The flow of air may carry the shampoo formulation used together with any waste and oil(s) removed by washing the hair with the shampoo formulation, which may then be captured by a collector 116, and the air is expelled from the device 100.

In one embodiment, the collector 116 includes an annular vent positioned at the rear of the device 100 and surrounding the cartridge. The vent allows the flow of air to leave the device 100, while the shampoo used and the waste are trapped in the collector 116. In one embodiment, the collector 116 may be detached from the device 100 and placed in a dishwasher so as to allow it to be cleaned in the dishwasher. In one embodiment, the surface of the collector 116, which is in contact with the shampoo formulation used, is coated in a hydrophobic or hydrophilic material to make it easier to clean the collector.

In one embodiment, the vacuum motor 114 is controlled by a multifunctional, multi-position selector. A selector may be a sliding switch or a dial switch with more than two positions, or a push-button switch with more than two positions, for example. In one embodiment, a vacuum selector includes settings for stopping and more than one vacuum speed setting, such as high and low.

In one embodiment, the vacuum switch is positioned on the rear side of the lower part of the handle 104 to allow operation with the thumb, for example. The vacuum switch 110 may be isolated for uninterrupted vacuum. LEDs may be used to illuminate the selected position. The selector 110 remains in the selected position until it is moved into another position. In one embodiment, a momentary action switch may replace the selector, wherein the default position of the momentary action switch is the off position, and it is necessary to press the momentary action switch to start the vacuum motor. In one embodiment, the device 100 includes both a vacuum selector and a momentary action switch, the momentary action switch being used to control the vacuum motor when it is pressed, and the speed being set by way of the selector.

Power Source 5

The device 100 includes a power source 5. In one embodiment, the device 100 is powered by a common mains AC supply which involves an electric cord (not shown) for powering the device 100. In one embodiment, the device 100 is powered by a DC supply, such as a rechargeable battery which can be charged by connecting it to a mains AC socket. A device 100 powered by a DC supply makes it possible to use the device without remaining in the vicinity of an electric socket.

In FIGS. 1 and 2, the device has a plurality of pumps 37, 38, 39, 40, 41, 42 each connected to its own dedicated suction nozzle 77, 78, 79, 80, 81, 82 and the dispensing opening 130 is situated at the centre of the support 10.

In FIGS. 3 and 4, the device has a single pump 37 connected to six independent suction nozzles 77, 78, 79, 80, 81, 82 and the dispensing opening 130 is situated at the centre of the support 10.

In FIGS. 5 and 6, the device is identical to the one in FIGS. 3 and 4, except that the independent suction nozzles 77, 78, 79, 80, 81, 82 are set in motion by a drive mechanism including a motor 78 and a camshaft 79 for synchronizing the movements of the nozzles. It can convert the continuous rotational movement of the shaft into an alternating movement in translation of the nozzles, in order to bring about controlled tapping on the hair or the scalp.

Use of the Device According to the Invention

With reference to FIG. 7, the device 100 is shown schematically in order to illustrate the main components according to the embodiments described above.

With reference to FIG. 8, an embodiment for cleansing the hair with the device 100 is illustrated. In block 120, the vacuum motor 114 is switched on by a user. At this point, the user can move the device 100 towards the zone of the scalp that they wish to cleanse in preparation for dispensing the shampoo formulation.

From block 120, the method passes to block 122. In block 122, the nebulizer 112 is switched on while the vacuum 114 is in operation. Before switching on the nebulizer 112, the user will have moved the device 100 so that it is at the desired location on the scalp for cleansing. The user now presses the mist switch 106. From block 122, the method passes to block 124.

In block 124, having pressed the mist switch 106 to dispense the shampoo formulation, the user can massage the scalp and the roots of the hair with the application elements 12 while the vacuum is in operation. The vacuum removes the shampoo formulation used with all the waste collected, such as cells of hair or dead skin, and any oil or haircare formulation applied beforehand. From block 126, the method passes to block 128.

In block 126, the user moves the application elements to a new zone on the scalp that they wish to cleanse and repeats these operations of forming mist, massaging and vacuuming. When the entire scalp has been cleansed, the user can switch off the vacuum in block 128.

The device 100 allows mechanical actions, including vacuuming, "scraper" and wiping actions, combined with a chemical action, such as that of surfactants and molecules capable of capturing and removing oil from the hair, in order to cleanse the hair.

The use of the device 100 has a minimal impact on the hairstyle, and the overall shape of the device is familiar from other instruments for the hair, such as a hairdryer, resulting in simple, intuitive use of the device 100. Moreover, the device 100 does not require any manual contact with the haircare formulations. The device 100 allows people to cleanse their hair only as required, in order to maintain their hairstyle long term and to limit damage caused to the hair, in contrast to washing their hair each time they take a shower.

While illustrative embodiments have been illustrated and described, it will be appreciated that various modifications can be made thereto without departing from the spirit and scope of the invention.

The invention claimed is:

1. A device for cleansing and applying a composition to the hair, comprising:

a body structure comprising a first, dispensing opening and a second, vacuum opening, a nebulizer with an outlet connected to the first, dispensing opening, a vacuum system with an inlet connected to the second, vacuum opening, and a handle extending the body structure, wherein the body structure has a support having a peripheral edge delimited by a perimeter line, the support extending along a longitudinal axis, and application elements extending from a longitudinal face of the support along a longitudinal axis, the application elements having a first, free end and a second end connected obliquely or perpendicularly to the longitudinal face of the support, the first, dispensing opening and the second, vacuum opening onto the longitudinal face of the support without passing through the application elements, and wherein the body structure has a suction nozzle that is movable in translation along its longitudinal axis and ends with the second, vacuum opening, a drive mechanism setting the suction nozzle in motion with an oscillating movement along the longitudinal axis of the suction nozzle.

2. The device according to claim 1, wherein the longitudinal face is flat.

3. The device according to claim 1, wherein the support has an external surface of non-circular shape in cross section perpendicularly to the longitudinal axis of the support.

4. The device according to claim 1, wherein the support has an external cross section perpendicularly to the longitudinal axis of the support of polygonal and/or flattened shape.

5. The device according to claim 1, wherein the application elements are closer to the perimeter line than to the longitudinal axis of the support.

6. The device according to claim 1, wherein the first, dispensing opening and the second, vacuum opening are closer to the longitudinal axis of the support than to the perimeter line.

7. The device according to claim 1, wherein the application elements are disposed in rows, with bases of the application elements in the rows being aligned or disposed in a staggered manner.

8. The device according to claim 1, wherein the support has a symmetric shape relative to a median plane containing the longitudinal axis of the support.

9. The device according to claim 1, wherein the vacuum system comprises an air pump or a water pump.

10. The device according claim 1, wherein each suction nozzle is connected to a pump outlet by its own dedicated outlet duct.

11. The device according to claim 1, wherein at least two suction nozzles are connected to the same outlet of a pump by a common outlet duct.

12. The device according to claim 1, wherein the first, dispensing opening is positioned at the centre of the longitudinal face of the support.

* * * * *